US007080663B2

(12) United States Patent
Kauss et al.

(10) Patent No.: US 7,080,663 B2
(45) Date of Patent: Jul. 25, 2006

(54) VALVE ASSEMBLY

(75) Inventors: Wolfgang Kauss, Franche Ville (FR); Didier Desseux, Solaize (FR)

(73) Assignee: Bosch Rexroth AG, Stuttgart (DE)

( * ) Notice: Subject to any disclaimer, the term of this patent is extended or adjusted under 35 U.S.C. 154(b) by 0 days.

(21) Appl. No.: 10/506,491

(22) PCT Filed: Jan. 27, 2003

(86) PCT No.: PCT/DE03/00209

§ 371 (c)(1),
(2), (4) Date: Oct. 12, 2004

(87) PCT Pub. No.: WO03/074883

PCT Pub. Date: Sep. 12, 2003

(65) Prior Publication Data

US 2005/0115620 A1 Jun. 2, 2005

(30) Foreign Application Priority Data

Mar. 4, 2002 (DE) ..... 102 09 399
Apr. 26, 2002 (DE) ..... 102 18 783

(51) Int. Cl.
*F16K 11/07* (2006.01)

(52) U.S. Cl. ..... 137/625.66; 60/470

(58) Field of Classification Search ..... 137/625.66; 60/462, 470; 91/461
See application file for complete search history.

(56) References Cited

U.S. PATENT DOCUMENTS

| | | | | |
|---|---|---|---|---|
| 4,359,931 | A | 11/1982 | Palmersheim et al. | |
| 5,613,519 | A | 3/1997 | Ishizaki | |
| 6,256,986 | B1 | 7/2001 | Langen et al. | |
| 6,581,639 | B1 * | 6/2003 | Fiala et al. | 137/596.2 |

FOREIGN PATENT DOCUMENTS

| | | |
|---|---|---|
| DE | 196 46 447 A1 | 5/1998 |
| DE | 198 31 595 A1 | 1/2000 |
| DE | 199 09 714 A1 | 9/2000 |
| DE | 100 33 757 A1 | 1/2002 |
| DE | 100 47 632 A1 | 4/2002 |
| WO | WO 95/32364 | 11/1995 |

* cited by examiner

*Primary Examiner*—Edward K. Look
*Assistant Examiner*—John K. Fristoe, Jr.
(74) *Attorney, Agent, or Firm*—Oliff & Berridge, PLC

(57) ABSTRACT

A valve assembly for load pressure-independent control of consumers is disclosed, which includes a main valve having a directional element and a metering throttle part. The valve assembly includes a shut-off valve for leakage-free shutting off of a work line leading to the consumer. This shut-off valve is designed with a pilot valve whereby a pressure chamber of the shut-off valve acting in the closing direction may be relieved towards a tank or a low-pressure source. The pilot valve is, in accordance with the invention, controlled open by a main slide of the main valve.

13 Claims, 3 Drawing Sheets

VALVE ASSEMBLY

The invention relates to a valve assembly for load pressure-independent control of consumers.

BACKGROUND OF THE INVENTION

The like valve assemblies are employed, e.g., in LIFD (Load-independent Flow Distribution) systems as known from WO 95/32364 A1 and Data Sheet RD 64 127/04.98 (Hydraulic Valves for Mobile Applications). An LIFD system includes, for instance, a variable displacement pump which may be regulated such as to generate at its output a pressure that is higher than the highest load pressure of all hydraulic consumers by a specific differential amount.

Each consumer is associated with a variable metering throttle with a downstream pressure compensator, with the latter maintaining the pressure drop across the metering throttle constant, so that the amount of pressure medium flowing to the corresponding hydraulic consumer depends not on the load pressure of the consumer or on the pump pressure, but solely on the open cross-section of the metering throttle. With the aid of the pressure compensators of the system it is achieved that in a case where the hydraulic pump was adjusted to the maximum stroke volume and the pressure medium flow is not sufficient for maintaining the specified pressure drop across the metering throttles, the pressure compensators of all of the actuated hydraulic consumers are adjusted in the closing direction, so that all the pressure medium flows are reduced by a same percentage. Due to this load-pressure independent flow distribution (LIFD), all of the actuated consumers move at a velocity that is reduced percentually by a same value.

In the solution in accordance with WO 95/32364 A1, if a consumer is supported for a prolonged period of time, it may happen that the latter will subside due to a small leakage flow between the work port subjected to pressure medium and the pressure medium tank of the system.

In order to avoid such a leakage flow, it is suggested in DE 196 46 447 A1 to insert in the respective work port a check valve that is capable of being controlled open and permits to shut off the work line leading to the consumer and subjected to pressure medium without any leakage. It is a drawback in this solution that considerable structural space is used up by mounting the check valve onto the work port.

SUMMARY

Instead of the add-on check valve it is also possible to realize the valve housing designed in disc design with an integrated check valve. As such leakage-free designs, other than the above-described conventional designs, are only utilized comparatively rarely, such a special design might only be realized at a comparatively high financial expense.

In comparison, the invention is based on the objective of furnishing a compact valve assembly that may be manufactured at minimum expense.

This objective is attained through a valve assembly having the features of claim 1.

In the valve assembly in accordance with the invention, the shut-off valve permitting leakage-free shutting is designed with a pilot valve through which the shut-off valve may be controlled open so as to permit a pressure medium flow towards the tank. In accordance with the invention, the pilot valve is actuated by an actuation movement of a main slide of a main valve whereby the work ports of the valve assembly that are connected with the consumer may be connected with a pressure medium tank or with a pressure passage conducting the pump pressure. In accordance with the invention, the pilot valve is arranged substantially coaxially with the main slide of the main valve determining the direction of pressure medium flow, and is in operative connection with the latter, so that the valve assembly may be given an extremely compact design. The solution of the invention including the pilot valve that is directly actuated through the main valve allows to laterally mount onto a standard disc a valve housing, wherein the pilot valve, the associated shut-off valve, and the associated work port are formed.

In accordance with the invention it is preferred if a tappet is formed at the main slide on the end face side of the main valve, which tappet raises the pilot piston from its pilot control seat upon corresponding driving of the main slide, so that a control surface of the shut-off valve that acts in the closing direction is relieved of load.

The main slide has a particularly simple construction if the tappet is inserted into the main slide as an insert member.

The laterally added-on valve housing may be given a particularly simple construction if the axis of the pilot valve extends at a parallel distance from the axis of the shut-off valve.

In a solution having a particularly simple construction, the control surface of the shut-off valve acting in the closing direction is connected via the pilot valve with a control port conducting, in the event of the axial displacement of the main slide of the main valve described at the outset, a comparatively low pressure corresponding, e.g., to the tank pressure.

In order to prevent abrupt opening of the shut-off valve, the pilot piston of the pilot valve is preferably provided with fine-control grooves through which the connection with the low-pressure port, for example the above described control port, is opened gradually.

In order to avoid pressure peaks and cavitation phenomena, a pressure limiting/anti-cavitation valve is associated to the shut-off valve. A port of this valve is connected with a tank port of the valve assembly via a tank passage. The construction of the laterally added-on valve housing is particularly simple if this tank passage encompasses a housing cartridge of the shut-off valve as an annular passage that preferably extends from the laterally added-on valve housing into the valve disc.

The main slide is biased through reset spring means into its neutral position. These reset spring means are configured such that the reset spring acting against the direction of actuation for actuating the pilot valve will only take effect after a predetermined initial stroke of the main slide, so that initially, the main slide essentially only has to be displaced against the force acting on the pilot piston.

In a preferred embodiment, this is achieved in that the respective reset spring is supported on a spring cup which contacts a support shoulder only after the above mentioned initial stroke, so that following contact, further axial displacement of the main slide takes place against the force of the reset spring.

In a preferred embodiment, the main valve forms a variable metering throttle followed downstream by a pressure compensator that is shared by the two work ports and the axis of which is preferably capable of being accommodated in the valve disc perpendicularly to the axis of the main valve.

Other advantageous developments of the invention are subject matter of the further subclaims.

BRIEF DESCRIPTION OF THE DRAWINGS

In the following a preferred embodiment of the invention shall be explained in more detail with the aid of schematic drawings, wherein.

DETAILED DESCRIPTION OF THE PREFERRED EMBODIMENT

The valve assemblies described hereinbelow are used for driving mobile work tools, such as shovel diggers, and customarily are designed in disc design. Here several ones of the valve discs are combined into one control block, with the valve elements for each function (actuate shovel, travelling mechanism, lift/lower) are respectively combined in one valve disc.

Figure 1:
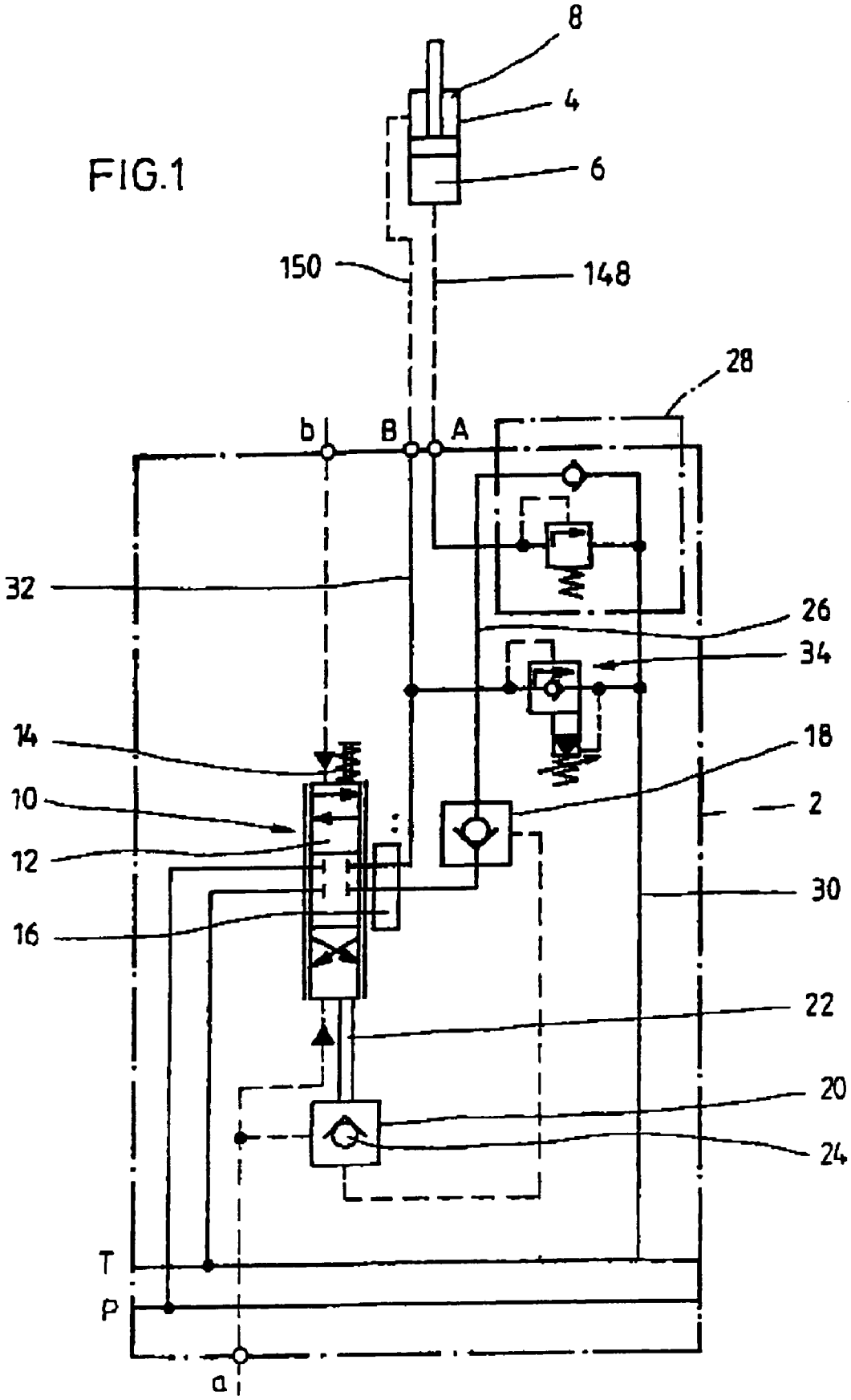
FIG. 1 shows a highly simplified circuit diagram of the valve assembly of the invention.

FIG. 1 shows a highly simplified hydraulic circuit diagram of a directional control valve element 2 for driving a double-action hydraulic cylinder 4.

The directional control valve element 2 is designed with a pressure port P, a tank port T, two work ports A, B, an LS port (not represented), and two control ports a, b. The work port A is connected with a piston base-side cylinder chamber 6, and the other work port B with an annular chamber 8 of the hydraulic cylinder. The directional control valve element 2 includes a main valve 10 designed as a continuously variable directional control valve, the main slide 12 of which is biased by reset spring means 14 into the represented Zero position. The displacement of the main slide 12 is achieved through application of a control pressure via the two control ports a, b. As shall be set forth in more detail hereinbelow, the main valve 10 is designed with a velocity element (not represented in FIG. 1) constituting a metering throttle, and a directional element determining the pressure medium flow from and to the chambers 6, 8, respectively. Downstream from the metering throttle a pressure compensator 16 (indicated schematically in FIG. 1) is arranged, which is acted upon by the pressure at the outlet of the metering throttle in the opening direction, and by the load pressure at the consumer (hydraulic cylinder 4) in the closing direction. As was mentioned at the outset, the downstream pressure compensator 16 maintains constant the pressure drop across the metering throttle represented by the main valve 10, whereby a load pressure independent flow distribution (LIFD) is made possible. Such LIFD controls are known from the prior art, e.g., WO 95/32364 A1, so that further explanations may be omitted.

For the case that the hydraulic cylinder 4 it to be held in an extended position, the pressure medium must be held under pressure in the cylinder chamber 6 without any leakages. To this end there is provided in the directional control valve element 2 a pilot-controlled shut-off valve 18, the pilot valve 20 of which is arranged about coaxially with the valve axis of the main valve 10. In other words, shut-off valve 18 and pilot valve 20 are arranged separately from each other in the variant in accordance with the invention. The shut-off valve 18 permits a pressure medium flow from the main valve 10 towards the work port A; a pressure medium flow in the reverse direction is only possible when the pilot valve 20 is actuated. Via the pilot valve 20 it is possible to relieve pressure on a control surface that acts in the closing direction of the shut-off valve, so that the shut-off valve 18 is opened by the pressure in the cylinder chamber 6, and pressure medium flow from the cylinder chamber 6 towards the tank port T is enabled. Actuation of the pilot valve 20 is achieved in accordance with the invention through the intermediary of a tappet 22 of the main slide 12, whereby a pilot piston 24 may be raised from a valve seat, so that the pressure medium acting on the control surface of the shut-off valve 18 in the closing direction may be relieved towards the control port a. The latter conducts a control pressure approximately corresponding to the tank pressure in the event of a displacement of the main slide 12 towards the pilot valve 20.

In a work passage 26 between the work port A and the main valve 10 a pressure/anti-cavitation valve 28 is arranged, which on the one hand limits the pressure in the work passage 26 to a maximum value, opens up a tank passage 30 leading to the tank port T when the pressure is exceeded, and enables replenishing of pressure medium from the tank passage 30 in the event of a very rapid extension movement of the hydraulic cylinder 4 caused, e.g., by travelling movements etc.

In another work passage 32 leading to the work port B a pilot-controlled pressure/feed valve 34 is provided, whereby the pressure in the another work passage 32 may be limited to a variable maximum value and may be fed via the pressure medium from the tank passage 30 into the another work passage 32.

By combining several ones of the above described directional control valve elements 2 including an inlet element and a terminal plate, it is possible to compose a highly compact control block for fulfilling mobile hydraulics tasks which may, thanks to the sandwich design, very easily be adapted to different operating conditions.

Figure 2:
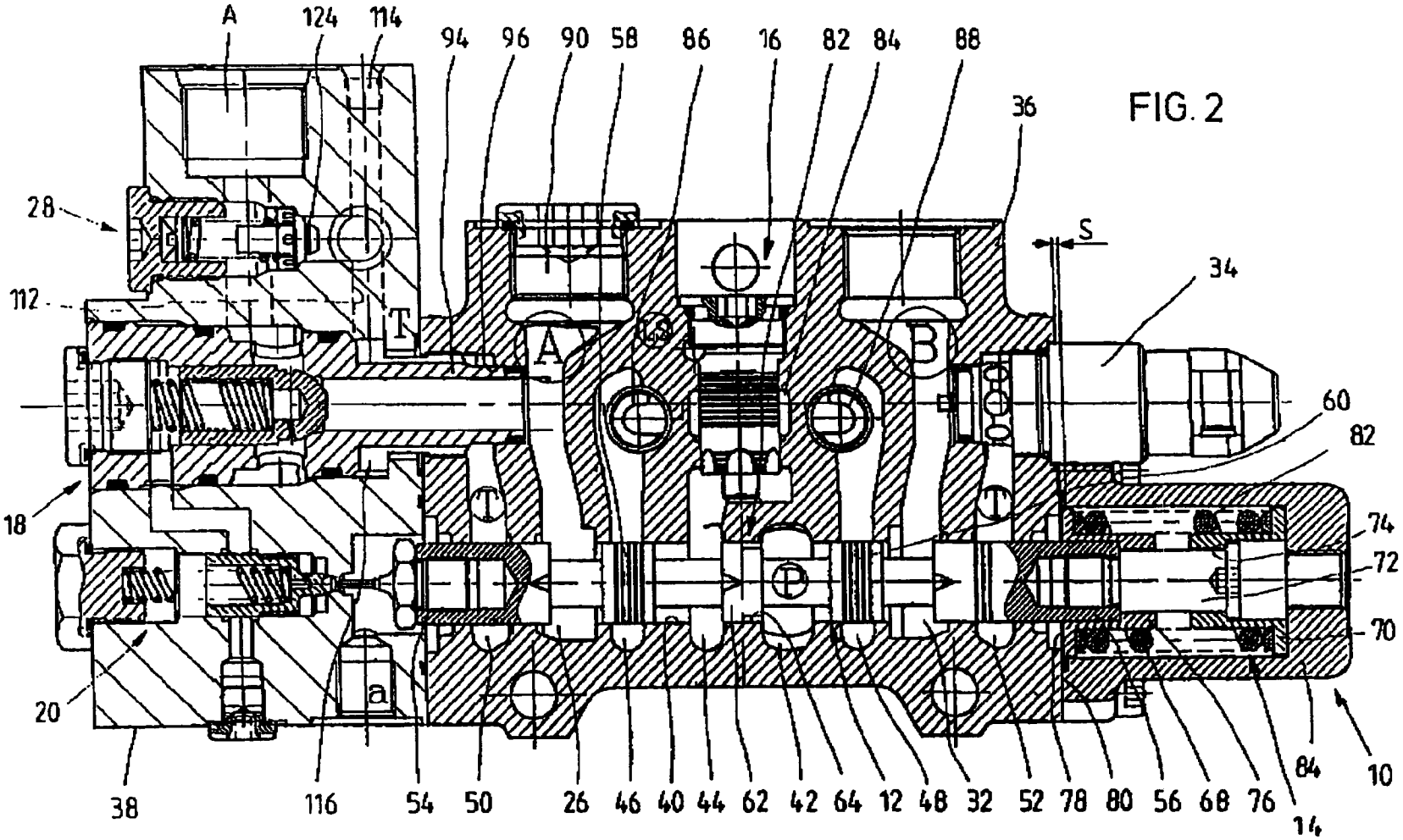
FIG. 2 shows a sectional view of the valve assembly of the invention in disc design.

FIG. 2 is a sectional view of a directional control valve element 2 in accordance with FIG. 1. Such a directional control valve element realized in disc design has a valve disc 36 which essentially is a standard component as described, e.g., in the applicant's Data Sheet RD 64 127/04.98. Laterally on the valve disc 36 a valve housing 38 is added on, wherein those valve elements are combined that are not present in a standard design in accordance with the above identified data sheet.

The work port B, the pressure port P, the tank port T, the control port b (not represented), and the LS port are formed in the valve disc 36. The valve disc 36 is penetrated by a valve bore 40 wherein the main slide 12 of the main valve 10 is guided. A central pressure chamber 42, a pressure compensator passage 44, two connecting passages 46, 48, the work passage 26, the another work passage 32, and tank passage sections 50, 52 merge radially into the valve bore 40. The main slide 12 is formed with an end face-side annular collar 54 at its left-hand end section and with a annular collar 56 at its right-hand end section. In addition the main slide 12 has two control collars 58, 60 of the directional element, with the control collar 58 being associated to work port A, and the control collar 60 to the work port B. Between the two control collars 58, 60 there is a measuring orifice collar 62 provided in both annular end faces thereof with fine-control grooves 64.

In the represented basic position of the main slide 12, the end face-side annular collars 54, 56 close the tank passage sections 50, 52, the control collars 58, 60 close the two connecting passages 46, 48, and the fine-control grooves 64 of the measuring orifice collar 62 are blocked by the central land of the valve bore 40.

On the right-hand lateral face of valve disc 36 in the view of FIG. 2, the reset spring means 14 is added on. It comprises a reset spring 68, the right-hand end section of which in the view of FIG. 2 is supported on a spring cup 70 that is guided, in an axially slidable manner, on a slideway 72 inserted end face-wise in the main slide 12. This slideway has a radial shoulder 74 against which the spring cup 70 is biased to the right through the force of the reset spring 68.

The other end of the reset spring 68 is supported on another spring cup 76 which in turn is biased by the reset spring 68 against the end face of the main slide 12. In this basic position a play S exists between the left-hand end face 78 of the spring cup in the view of FIG. 2 and a contact shoulder 80. As may be seen in FIG. 2, the another spring cup 76 is slidingly guided on the right-hand annular collar 56 of the main slide 12 and on the slideway 72. The spring cups 70, 76 may thus approach each other in the event of an axial displacement of the main slide 12. The spring chamber 82 receiving the reset spring 68 and the spring cup 70, 76 is encompassed by a cover 84 and may be subjected to the pressure at control port b.

As was explained by referring to FIG. 1, the work passage 32 associated to the work port B may be connected with the tank passage T via the pressure/feed valve 34 in order to limit the pressure in the work passage 26 or replenish pressure medium from the pressure medium tank. The pressure/feed valve represented in FIG. 2 is designed with pilot control. It thus is a standard component realized in cartridge design, with further explanations accordingly being omitted.

Into the pressure compensator passage 44 the pressure compensator 16 is inserted, the valve axis of which extends perpendicularly to that of the main valve 10. The pressure compensator piston 82 is subjected in the opening direction to the pressure downstream from the measuring orifice 82 defined by the measuring orifice collar 62, and in the closing direction to the pressure at the LS passage as well as the force of a control spring.

The outlet port 84 of the pressure compensator 16 is connected via respective load-holding valves 86, 88 with the connecting passage 46 associated with the work port A and with the connecting passage 48 associated with the work port B, respectively. Such a load-holding valve 86 fundamentally constitutes a check valve permitting a pressure medium flow from the outlet port 84 of the pressure compensator 16 to the associated passage 44 or 46 while blocking in the opposite direction.

In the embodiment represented in FIG. 2, the work port A provided at the standard valve disc 36 is shut off by a closure member 90. The work port A is formed in the laterally added-on valve housing 38. In this valve housing 38 there are accommodated the pilot valve 20 formed coaxially with the main valve 10, the shut-off valve 18 associated thereto, and the pressure/anti-cavitation valve 28 associated to the work port A, with the axes of these valve elements extending in parallel (18, 28) or coaxially (20), respectively, with the axis of the main valve 10.

Details of the valve housing shall hereinbelow be explained by referring to the partial representation in accordance with FIG. 3.

The shut-off valve 18 includes a housing cartridge 92 inserted in a transverse bore 96, which penetrates the valve housing 38 in the horizontal direction (view of FIG. 3), and the end section 94 of which plunges into an extension of the transverse bore 96 that communicates with the work passage 26 in the valve disc 36.

The housing cartridge 92 has a stepped axial bore 98 on which a valve seat 100 is formed, against which a cone 102 of the shut-off valve 18 is biased through the intermediary of a compression spring 104. The latter is supported on a closure screw 106 screwed into the housing cartridge 92.

A group of radially arranged bores 108 of the housing cartridge 92, which in turn is connected with a passage 110 leading to the work port A, merges into the axial bore 98. In the range of the radially arranged bores 108 there is formed, in the jacket of the cone 102, a connecting bore 109 whereby a spring chamber 105 accommodating the compression spring 104 is connected with the passage 110, so that the shut-off valve is biased against the valve seat 100 by the pressure in the passage 110 in addition to the force of the compression spring 104.

In the valve housing 38 there is moreover formed a tank bore 112 realized as an angular bore, the horizontal leg of which (view of FIG. 3) does not intersect the passage 110. This may be achieved, for instance, by the tank bore 112 being offset relative to the passage 110. In addition both the work passage and also the tank passage may be formed by parallel bores.

In the represented embodiment, the tank bore 112 is formed by a vertical bore and a horizontal bore intersecting the latter, wherein the vertical bore is closed by a closure member 114, while the pressure/anti-cavitation valve 28 is inserted in the horizontal bore. In accordance with FIG. 3, the tank bore 112 opens into an annular chamber 116 delimited by a radially expanded part of the transverse bore 96 of the valve housing 38 and the outer periphery of the end section 94 of the housing cartridge 92. The tank passage section 50 merges into this annular chamber 116, so that the tank bore 112 is connected with the tank port T.

Figure 3:
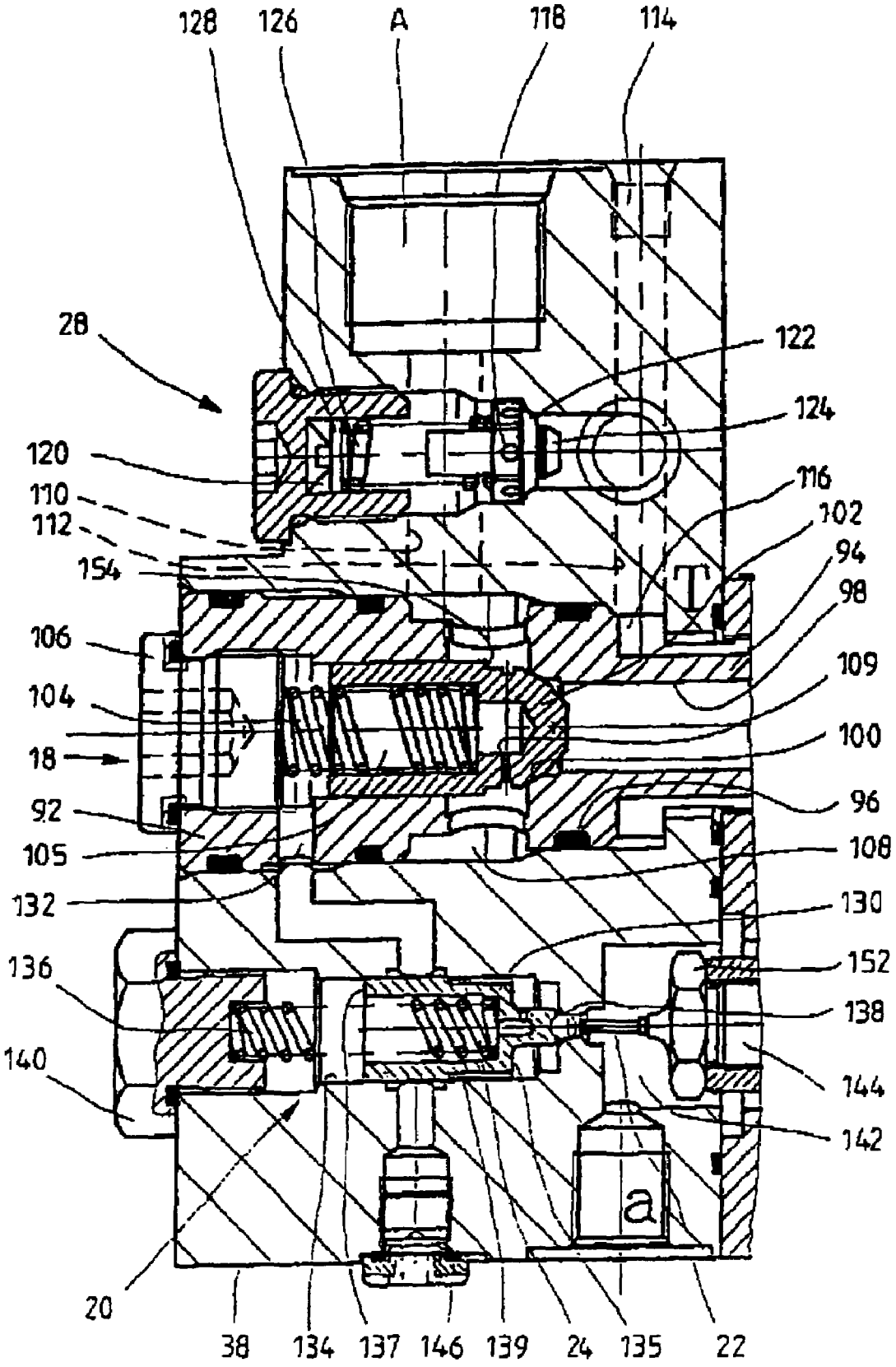
FIG. 3 shows a partial representation of the valve assembly of FIG. 2.

In accordance with FIG. 3, the pressure/anti-cavitation valve 28 has an anti-cavitation piston 118 that is biased against a seat 122 by a spring 120. Inside the anti-cavitation piston 118 a pressure limiting piston 124 is guided which is biased against a valve seat (not represented) in the anti-cavitation piston 118 through the intermediary of a pressure limiting spring 126. In the represented embodiment, the pressure limiting spring 126 attacks on a cup 128 formed on a part of the pressure limiting piston 124 that protrudes into the spring chamber.

In the valve housing 38 there is moreover formed a control passage 130 merging on the one hand into a radial bore 132 of the housing cartridge 92 and on the other hand into a stepped pilot bore 134 accommodating the pilot valve 20. In this stepped pilot bore 134, the pilot piston 24 is biased against a pilot control seat 138 through the intermediary of a pilot spring 136, with the pilot spring 136 being supported on a closure member 140. Via this valve seat 138 the pilot bore 134 merges into a control chamber 142 into which the left-hand annular collar 54 of the main slide 12 merges, and which is connected with the control port a. Into the end face of the annular collar 54 an insert member 144 carrying the tappet 22 is inserted, with the tappet 22 being shaped such that it is capable of plunging into the pilot control seat 138 in order to raise the pilot piston 24 from the pilot control seat 138 against the force of the pilot spring 136. The pilot piston 24 is designed as a stepped piston, with the cone of the pilot piston 24 that co-operates with the pilot control seat 138 has a substantially smaller diameter than the adjacent annular end face 135 or the rear-side end face 137 of the pilot piston 24. On the outer periphery of the pilot piston 24, fine-control notches 139 are formed whereby a pressure chamber delimited by the annular end face 135 and the pilot control seat 138 is connected with the control passage 130. The pressure present in this pressure chamber is tapped via a compensation bore 152 penetrating the pilot piston 24 and signalled into the spring chamber 136, so that the end faces of the pilot piston 24 are substantially pressure-balanced.

The portion of the control passage 130 merging into the pilot bore 134 is in turn formed by a bore that is closed with the aid of a closure member 146.

For extending the hydraulic cylinder 4, a control pressure is applied to the control port a, while the control port b is connected with the tank or with another low-pressure source. Owing to the pressure difference acting on the end faces, the main slide 12 is displaced from its spring-biased basic position (FIG. 2) to the right. The connection between the pressure chamber 42 and the pressure compensator passage 44 is controlled open via the fine-control grooves 64—the metering throttle 82 is opened, and pressure medium may flow to the inlet port of the pressure compensator 16. As was set forth at the outset, the latter adjusts itself, as a function of the acting load pressure and of the pressure downstream of the measuring orifice 82, in a control position wherein the pressure drop across the measuring orifice 82 may be maintained constant independently of load pressure. The pressure medium flows from the pressure compensator 16 via the load-holding valve 86 into the connecting passage 46. Due to the axial displacement of the main slide 12, a control land formed by the control collar 58 has controlled the connection between the connecting passage 46 and the another work passage 32 open, so that the pressure medium may flow in via the work passage 26 into the axial bore 98 of the housing cartridge 92 of the shut-off valve 18. The pressure of the pressure medium is so high that the cone 102 is raised from the valve seat 100 against the force of the compression spring 104 and the low pressure force in the spring chamber 105, and the pressure medium may flow in via the radially arranged bores 108 and the passage 110 to the work port A and from there via a work line 148 (FIG. 1) into the cylinder chamber 6—the piston of the hydraulic cylinder 4 extends. The pressure medium displaced from the annular chamber 8 flows via the line 150 (FIG. 1) to the pressure port B and from there into the work passage 32. Owing to the axial displacement of the main slide 12, the right-hand, end face-side annular collar 56 has controlled open the connection between the work passage 26 and the tank passage section 52 by means of a control land, so that the pressure medium may flow off from the work passage 32 towards the tank port T.

When a maximum pressure that is adjusted via the pressure/anti-cavitation valve 28 is exceeded, the smaller pressure limiting piston 124 is raised from its seat in the anti-cavitation piston 118 against the force of the pressure limiting spring 126 (to the right), so that the connection with the tank bore 112 is opened, and pressure medium may flow off via the tank bore 112, the annular chamber 116, and the tank passage section 50 towards the tank port T until the pressure at work port A has dropped below the maximum adjusted pressure.

The pressure/feed valve 34 is designed in a known manner to have an anti-cavitation function, so that pressure medium may be fed from the tank passage section 52 in the work passage 26 in order to avoid cavitations.

When the hydraulic cylinder 4 extends, the pilot valve 20 is closed as it is biased against the pilot control seat 138 by the force of the pilot spring 136. The pressure forces acting on the pilot piston 24 are essentially balanced, for the valve seat has a substantially smaller cross-section in comparison with the end faces of the pilot piston, and the end face portions of the pilot piston (with the exception of the area of the pilot control seat 138) are subjected to a same pressure.

Following the initial stroke S, the spring cup 76 contacts the contact shoulder 80, so that the further axial displacement of the main slide 12 is only possible against the force of the reset spring 68 received with a bias. Having passed through this initial stroke S, the pilot piston 24 is opened to such an extent as to be perfectly pressure-balanced, so that the force acting from the side of the pilot valve 20 on the main slide 12 is negligible, and its axial displacement is thus furthermore only influenced by the pressure at the control port b and the force of the reset spring 68 (equally about 5 bar). As a result of this initial stroke S, the main slide is thus not abruptly moved to the left when the pilot valve is opened and the pressure force (5 bar) correspondingly ceases, so that continuous control is ensured.

The fine-control notches 139 ensure that the shut-off valve 18 will only be relieved gradually, so that abrupt lowering of the load may be prevented.

For the case that the pressure in the passage 110 drops below the tank pressure (cavitation risk), the anti-cavitation piston 118 rises from its seat 122 against the force of the spring 120, so that pressure medium may be fed via the tank bore 112 into the passage 110.

In order to hold the load, the main valve 10 is moved back into its neutral position, so that the shut-off valve 18 is moved back by the force of the compression spring 104 into its blocking position in which the cone 102 rests on the valve seat 100, and the pressure medium is confined in the cylinder chamber 6 without any leakage.

In order to lower the load, the control port a is connected with the tank or with a low-pressure source, while a control pressure acts on the control port b to displace the main slide 12 to the left. Owing to the play S adjusted via the spring cup 56, the main slide 12 initially performs an initial stroke during which the reset spring 68 does not develop any effect yet. During this initial stroke the tappet 22 contacts the pilot piston 24, so that the axial projection thereof forming a closure cone is raised from the pilot control seat 138. In other words, during this initial stroke the axial displacement of the main slide 12 takes place against the force of the pilot spring 136 corresponding, e.g., to a pressure of about 5 bar. As a result of the axial displacement of the pilot piston 24, the connection between the pilot control seat 152 and the control passage 130 is gradually controlled open via the fine-control notches 139, so that pressure medium may flow off from the spring chamber 105 of the shut-off valve 18 via the radial bore 132, the control passage 130, the fine-control notches 139, the pilot control seat 138 and the control chamber 142 to the control port a that is connected with the pressure medium tank—the shut-off valve 18 is relieved of load on its rear side. Subsequently the cone 102 may be raised from the valve seat 100 by the load pressure acting on its annular surface 154, so that the pressure medium may flow off from the work port A via the passage 110, the axial bore 98, the another work passage 32, and the tank passage section 50 controlled open by the annular collar 54 towards the tank port T. Concurrently the pressure medium is conducted via the metering throttle 82, the pressure compensator 16, the connecting passage 48, and the work passage 26 controlled open by the control collar 60 to the work port B and from there into the annular chamber 8—the hydraulic cylinder 4 retracts.

A valve assembly for load pressure-independent control of consumers is disclosed, which includes a main valve having a directional element and a metering throttle part. The valve assembly includes a shut-off valve for leakage-free shutting off of a work line leading to the consumer. This shut-off valve is designed with a pilot valve whereby a pressure chamber of the shut-off valve acting in the closing direction may be relieved towards a tank or a low-pressure source. The pilot valve is, in accordance with the invention, controlled open by a main slide of the main valve.

What is claimed is:

1. Valve assembly for load pressure-independent control of consumers, including a main valve for regulating a pressure medium flow to or from the consumer, wherein in a pressure medium flow path between a work port and the main valve a shut-off valve is arranged which permits a pressure medium flow to the work port and which is capable of being controlled open in the opposite direction through the intermediary of a pilot valve, wherein a pilot piston of the pilot valve is capable of being raised from a pilot control seat by displacing a main slide of the main valve, and the valve axis of the pilot valve is arranged at a parallel distance from the axis of the shut-off valve and about coaxially with the axis of the main valve, and the main slide and the pilot piston are capable of being taken into contact via a tappet.

2. Valve assembly in accordance with claim 1, wherein the tappet is formed on the main slide.

3. Valve assembly in accordance with claim 1, wherein the tappet is formed on an insert member inserted in an end face of the main slide.

4. Valve assembly in accordance with claim 1, wherein the pilot valve and the shut-off valve are arranged in a common valve housing that is added on to an end face of a valve disc accommodating the main valve.

5. Valve assembly in accordance with claim 4, wherein at least one work port is formed at the valve housing.

6. Valve assembly in accordance with claim 4, wherein the housing cartridge merges into a work passage of the valve disc.

7. Valve assembly in accordance with claim 4, wherein with the aid of the main valve a variable metering throttle is formed, downstream from which a pressure compensator accommodated in the valve disc is arranged.

8. Valve assembly in accordance with claim 1, wherein a spring chamber of the shut-off valve is capable of being connected via the pilot valve with a low-pressure port, preferably a control port conducting the control pressure that acts on the main slide in a direction away from the pilot valve.

9. Valve assembly in accordance with claim 8, wherein the pilot piston includes fine-control notches for gradually opening the connection to the low-pressure port.

10. Valve assembly in accordance with claim 1, wherein the shut-off valve is followed downstream by a pressure/anti-cavitation valve.

11. Valve assembly in accordance with claim 10, wherein a port of the pressure/anti-cavitation valve is connected via a tank bore with a tank port, the tank bore encompassing a housing cartridge of the shut-off valve as an annular chamber.

12. Valve assembly in accordance with claim 1, wherein there is associated to the main slide at least one reset spring means acting, after a predetermined initial stroke of the main slide, contrary to the actuation force necessary for actuation of the pilot piston.

13. Valve assembly in accordance with claim 12, wherein the reset spring means comprises a reset spring supported on a spring cup that enters into contact against a contact shoulder following the initial stroke.

* * * * *